US007285742B2

(12) United States Patent
Kinzler et al.

(10) Patent No.: US 7,285,742 B2
(45) Date of Patent: Oct. 23, 2007

(54) SWITCHING DEVICE

(75) Inventors: Rudolf Kinzler, Freudenberg (DE); Ludwig Niebler, Laaber (DE); Anton Scharf, Ebermannsdorf (DE)

(73) Assignee: Siemens Aktiengesellschaft, Munich (DE)

( * ) Notice: Subject to any disclaimer, the term of this patent is extended or adjusted under 35 U.S.C. 154(b) by 128 days.

(21) Appl. No.: 10/998,053

(22) Filed: Nov. 29, 2004

(65) Prior Publication Data

US 2005/0135022 A1 Jun. 23, 2005

(30) Foreign Application Priority Data

Nov. 28, 2003 (DE) ..... 103 56 271

(51) Int. Cl.
*H01H 33/04* (2006.01)

(52) U.S. Cl. ..... 218/34; 218/149; 335/201

(58) Field of Classification Search ..... 218/22, 218/29–41, 147–149, 156, 157; 335/201, 335/202, 16, 195, 147, 131, 132; 200/245–247
See application file for complete search history.

(56) References Cited

U.S. PATENT DOCUMENTS

| | | | | |
|---|---|---|---|---|
| 5,635,886 | A | 6/1997 | Pichard | |
| 6,064,024 | A * | 5/2000 | Moldovan | 218/22 |
| 6,262,384 | B1 | 7/2001 | Niebler et al. | |
| 6,288,354 | B1 | 9/2001 | Niebler et al. | |
| 6,556,110 | B1 | 4/2003 | Niebler et al. | |

FOREIGN PATENT DOCUMENTS

| | | |
|---|---|---|
| DE | 693 02 599 T2 | 8/1993 |
| DE | 693 02 599 T2 | 9/1996 |
| DE | 297 20 715 U1 | 1/1998 |
| DE | 197 57 332 C1 | 7/1999 |
| DE | 199 35 661 A1 | 7/1999 |
| DE | 198 18 058 A1 | 11/1999 |
| DE | 198 18 058 C2 | 11/1999 |
| EP | 1 073 084 A2 | 1/2001 |
| EP | 1 103 996 A1 | 5/2001 |

* cited by examiner

*Primary Examiner*—Elvin Enad
*Assistant Examiner*—M. Fishman
(74) *Attorney, Agent, or Firm*—Sughrue Mion Pllc.

(57) ABSTRACT

The invention relates to a switching device with a switching structure (1), which includes a cage assembly (21) having two opposite first sidewalls (5) and a bottom wall (6) integrally connecting the first sidewalls. The cage assembly (21) is at least partly configured as a cage (24) in which a slide (4) is displaceably arranged. A moving contact bridge (3) associated with stationary contact members is held in an opening (15) of the slide (4) under the pressure of a contact pressure spring (2). A clearance (26) is provided between the two first sidewalls (5) for the displacement of the contact bridge (3). A limit stop (18) is provided to retain the slide (4). Arcing chambers (7) formed by insulating second sidewalls (23) form part of the switching structure (1). The second sidewalls (23) delimit a volume that contains the opening arcs, and the second sidewalls (23) are arranged on opposite sides of the cage assembly (21) including the cage (24) such that they are respectively separated therefrom by a gap (27).

17 Claims, 5 Drawing Sheets

SWITCHING DEVICE

The following disclosure is based on German Patent Application No. 10356271.0, filed on Nov. 28, 2003, which is incorporated herein by reference.

FIELD AND BACKGROUND OF THE INVENTION

The invention relates to a switching device with a switching structure that includes a cage assembly having two opposite first sidewalls and one bottom wall integrally connecting the first sidewalls. The cage assembly is at least partly configured as a cage in which a slide is displaceably arranged. A moving contact bridge associated with stationary contact members is held in an opening of the slide under the pressure of a contact pressure spring. A clearance is provided between the two first sidewalls for the displacement of the contact bridge. A limit stop is provided to retain the slide.

German Publication DE 693 02 599 T2 discloses a multipole isolating switch in which an isolating structure with disconnectable contacts is provided for each pole current path. Each pole current path includes two stationary contact members and two movable contacts arranged on a moving contact bridge, which forms a pole switch with dual interruption. The moving contact bridge is acted upon by a mechanism to open and close the contacts. This is effected by a depressor, which is guided in a stationary cage. The cage is made of an insulating material and includes a bottom wall and sidewalls perpendicularly extending therefrom and is provided with windows dimensioned to allow the displacement of the contact bridge, particularly under the action of the opening and closing mechanism in case of an electrodynamic recoil. The windows further define an upper limit stop for the contact bridge. A contact pressure spring is disposed between the bottom wall of the cage and the contact bridge in a central recess of the cage, which acts as a seat and linear guide of the depressor. The depressor is thus guided along the inner surfaces of the sidewalls of the cage. The walls of the depressor have openings dimensioned to allow, on the one hand, the insertion of the contact bridge into the depressor and on the other hand, an angular movement of the bridge relative to the depressor. The cage has insulating wings which extend in longitudinal direction over a distance slightly greater than the length of the contact bridge and the height of which is sufficient to create a volume that contains the opening arcs.

This arcing chamber assembly is mounted by first inserting the depressor or slide into the cage and holding it in a defined position. This makes a window in the slide accessible from the side under the webs forming the limit stops. After the contact pressure spring has been inserted into the cage from the top through a hole in the slide, the movable switching element is inserted by means of a die into the space of the window that is still remaining after the spring has been pushed through and is then rotated by 90° into its final operating position.

A switching device of the aforementioned type is described in EP 59901859. This document discloses a switching structure 1, a contact pressure spring 2, a moving contact bridge 3 and a slide 4 in an exploded view according to FIG. 1. In the view shown, the switching structure 1 essentially consists of two parallel, elongated sidewalls 5 connected at the bottom by a bottom wall 6 (not depicted). The space 7 between the two sidewalls 5, i.e., the interior space, is accessible from all sides except from the connecting bottom wall 6. In the center and perpendicularly to the long sides 8, a guide channel 10 is formed by contours 9 in the sidewalls 5 and is provided with slots 11 in the sidewalls 5. After the contact pressure spring 2 has been inserted into this guide channel 10 and is supported against the bottom wall 6, the moving contact bridge 3 is likewise inserted into the interior from the top. The dimensions of the guide channel 10 are adapted to the slide 4. After insertion of the moving contact bridge 3, the slide 4 is inserted into the guide channel 10 such that its lateral detents 12 latch with the aforementioned slots 11 and abut the contact bridge 3. For this purpose, the slide 4 has an opening 15 configured as a recess along the underside to accommodate the contact bridge 3. The upper limit of the slots 11 serves as a limit stop 18 for the slide 4. The sidewalls 5 have external grooves 13 into which arc splitter plates 16 of an arc splitter stack 17 are inserted. Once the aforementioned components have been mounted, an assembly 1 as shown in FIG. 2 is obtained. The described switching structure 1 has lateral insulating wings, which separate an interior space of the arcing chamber in which the opening arcs are created during operation of the switching device from an exterior space of the arcing chamber in which parts of the arc splitter arrangement are accommodated.

The complete assembly 1 consisting of the switching structure and the attached arcing chamber is inserted into a bottom part 19 of the switching device as shown in FIG. 3. A top part 20 illustrated in FIG. 4, in which stationary contact members, trigger mechanisms, switching mechanisms and other components are inserted, is latched to the assembled bottom part 19.

Joining the two preassembled parts, the bottom part 19 and the top part 20, causes the contact slides 4 in the bottom part 19 and the switching mechanisms in the top part 20 to engage. A resulting problem is that when high currents are switched, e.g., in case of short circuits, an arc plasma forms which can reach the top part 20 through gaps and can cause damage there, e.g., as a result of phase flashovers from one conducting path to another, smoke and thus short circuits on a printed circuit board, etc. To prevent this, the goal is always to keep the gaps between the bottom part 19 and the top part 20 as small as possible. This results in a contradiction in the area of the contact slide 4. When the bottom part 19 and the top part 20 are joined, the contact slides 4 are guided into openings in the top part 20. Too small a gap can cause the contact slide 4 to jam if the top part 20 and the bottom part 19 are misaligned.

To solve this problem, essentially two approaches are known:

1. The openings in the top part are made correspondingly large, such that the maximum occurring misalignment between the top part and the bottom part cannot cause the contact slide to jam. This necessarily creates a large gap between the top part and the bottom part.
2. The opening in the top part is configured such that a small gap remains between the contact slide and the opening in the top part after the top part and the bottom part have been joined. The entire assembly consisting of the switching structure and the attached arcing chamber is not fixed in the bottom part. Meshing elements are formed on the top part. When the top part and bottom part are jointed, the meshing elements on the top part ensure fixation. The drawback is that the meshing elements, due to design factors, are not solid enough to withstand the loads from the arcing chamber, e.g., the mechanical loads caused by short circuiting, stresses due to vibrations or shock during transport or use, etc. As a result, the meshing elements are deformed, which in turn causes the contact slides to jam.

OBJECTS OF THE INVENTION

One object of the invention is to provide a switching device of the aforementioned type with a switching structure in which jamming of the contact slide due to component tolerances and/or thermal and mechanical loading is avoided as much as possible.

A further object of the invention is to provide a method to manufacture such a switching device.

SUMMARY OF THE INVENTION

These and other objects may be attained as follows.

The switching structure has arcing chambers formed by insulating second sidewalls. These second sidewalls delimit a volume that contains the opening arcs. They are arranged on opposite sides of the cage assembly including the cage, and are respectively separated therefrom by a gap.

In one exemplary embodiment of the invention, a first web of an insulating material engages with the gap in a positive fit to prevent any harmful thermal stresses as a result of the opening arcs.

It is furthermore advantageous if the first web is part of a bottom part of the switching device in which the cage assembly with the cage is arranged.

If the two first sidewalls on the side facing away from the bottom wall are connected by at least one second web, then at least one of the clearance spaces for the contact bridge is delimited. This provides, for example, a limit stop for the contact bridge. It also stabilizes the cage assembly with the cage.

A further advantage is obtained if the two sidewalls are integrally interconnected in a U-shape.

To prevent the two second sidewalls from collapsing, they are fixed by spacer means on the side facing away from their connection. The spacer means are not part of the second sidewalls.

To simplify production, the first and second sidewalls are made part of an originally integral molded part made of an insulating material.

To influence the opening arcs, arc splitter plates surround the first sidewalls. Advantageously, at least one blow plate is provided for each switching point to influence the opening arc.

In a further exemplary embodiment, the first sidewalls are provided with the limit stop for the slide. The slide can be easily latched to the first sidewalls.

According to yet another exemplary embodiment, the slide has latching elements that engage with slots formed longitudinally to the slide's direction of movement. This provides a loose latching connection between the slide and the first sidewalls enabling the displacement of the slide during the switching process.

A method of the invention includes producing a molded part, which comprises a cage formed by two opposing first sidewalls and a bottom wall integrally connecting the same and second sidewalls integrally connected to the cage. The molded part is severed at the point where the second sidewalls are connected to the cage, whereby the cage assembly and the severed second sidewalls are obtained. The cage assembly and the severed second sidewalls are then inserted into the bottom part, with or without arc splitter plates, such that a defined gap is left, respectively, between the cage assembly and the second sidewalls.

BRIEF DESCRIPTION OF THE DRAWINGS

An exemplary embodiment of the invention will now be described in greater detail with reference to the drawings in which.

DETAILED DESCRIPTION OF THE EXEMPLARY EMBODIMENTS

Figure 1:
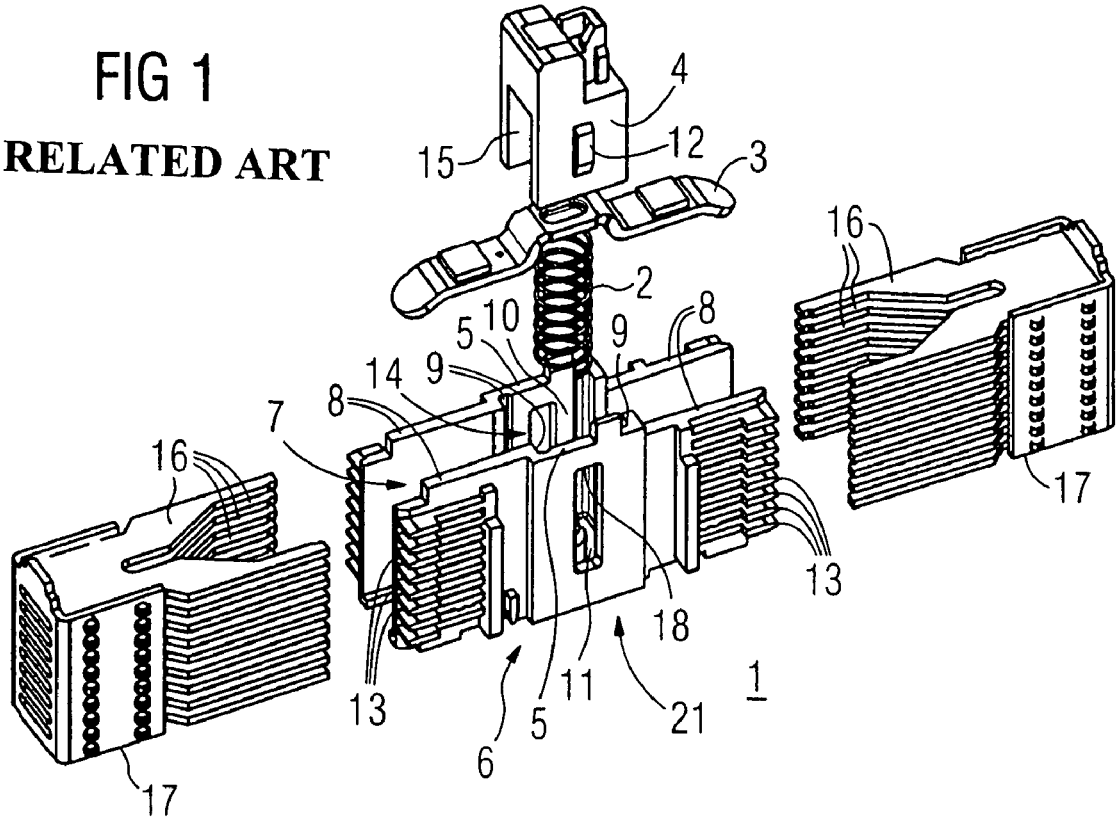
FIG 1 RELATED ART
FIG. 1 is an exploded view of a switching structure according to the related art.
Figure 2:
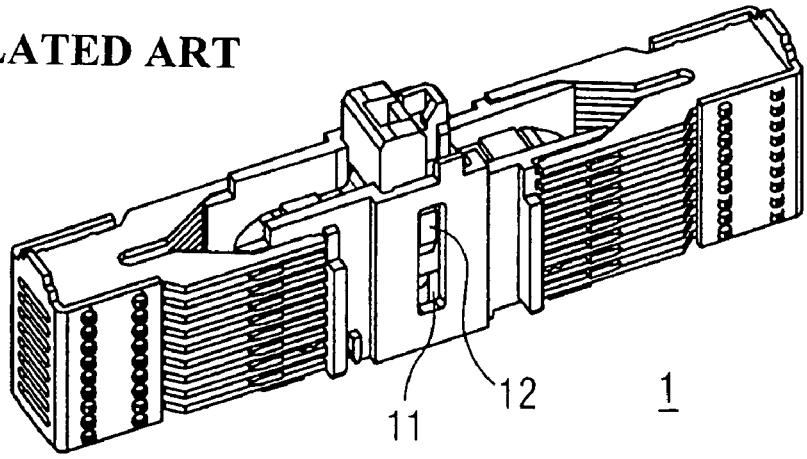
FIG 2 RELATED ART
FIG. 2 shows a mounted switching structure according to FIG. 1.
Figure 4:
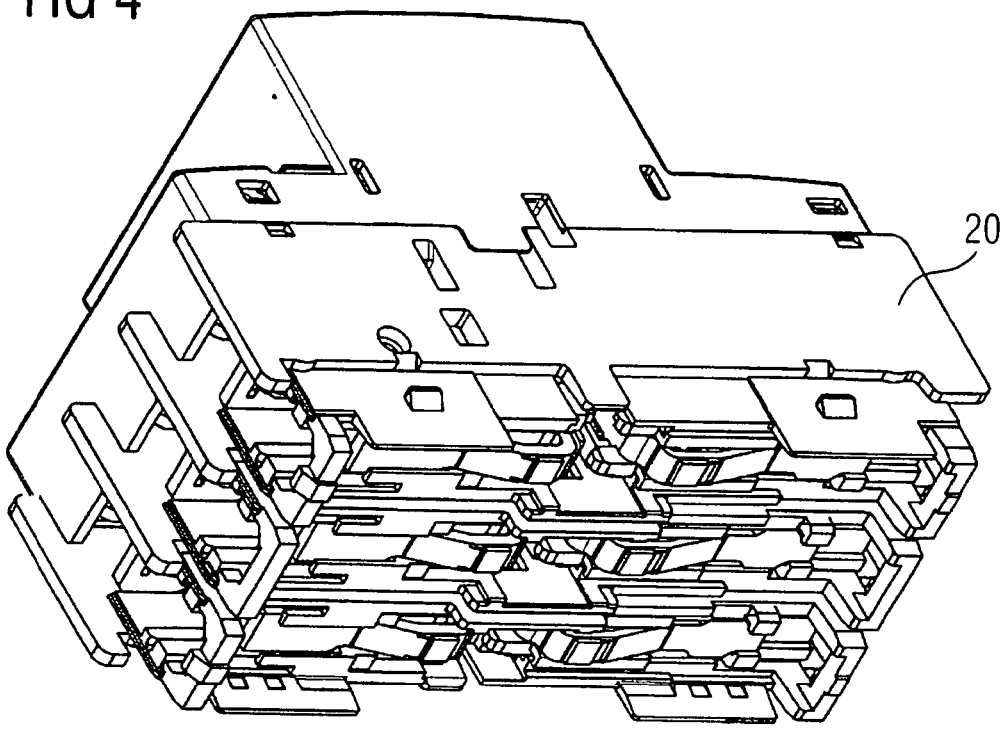
FIG. 4 shows a top part of a switching device.
Figure 3:
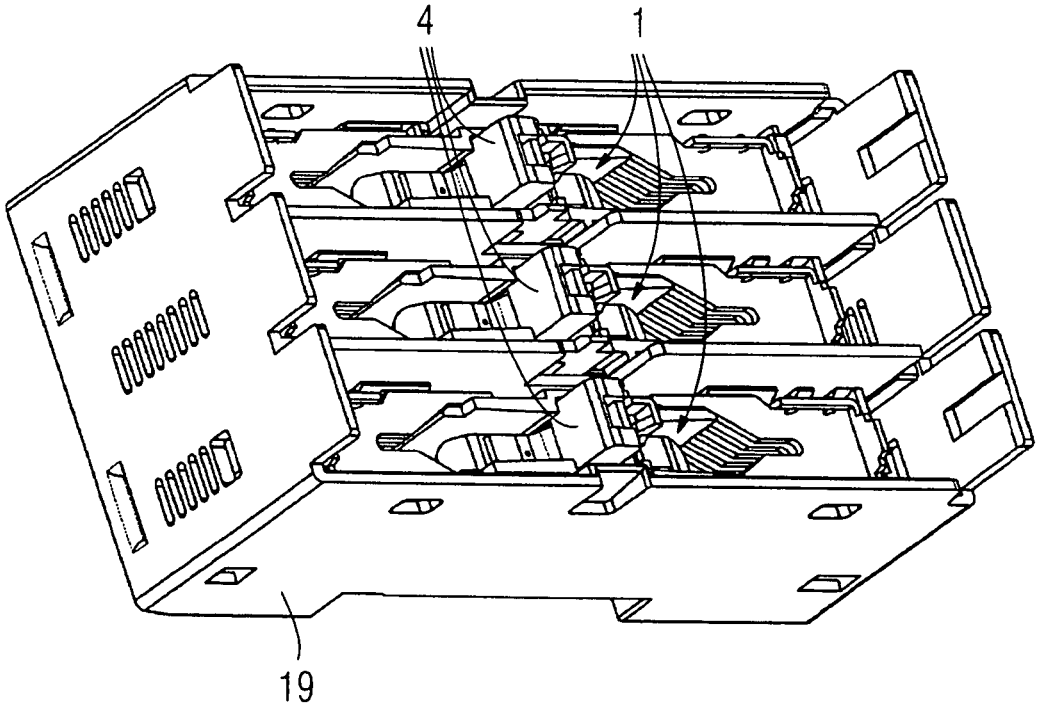
FIG. 3 shows a bottom part of a switching device with three switching structures.
Figure 5:
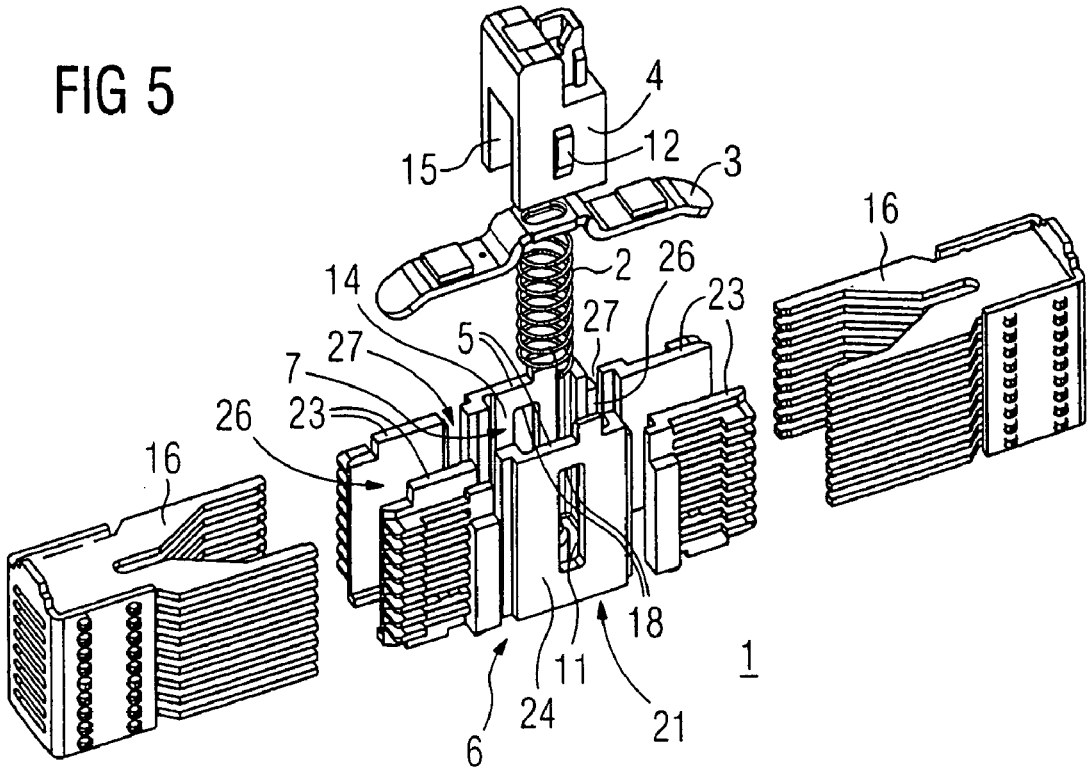
FIG. 5 is an exploded view of a switching structure of a switching device according to the invention.
Figure 6:
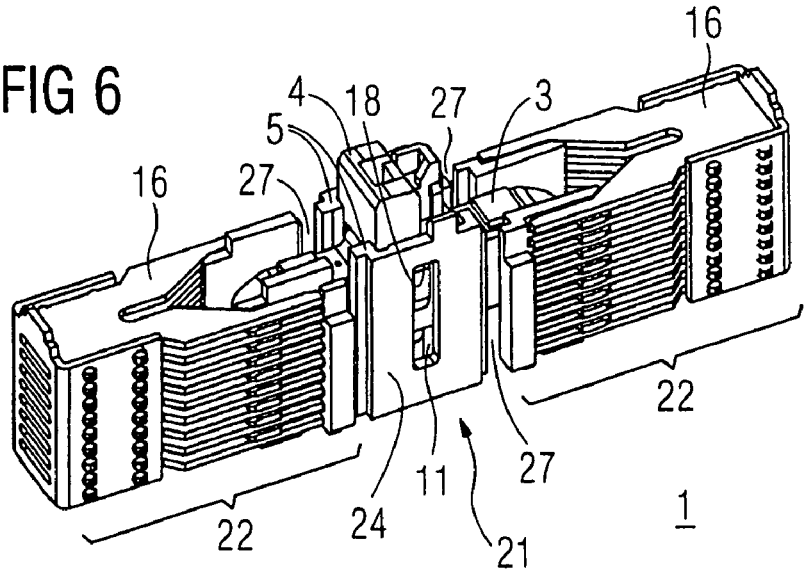
FIG. 6 is a perspective view of a switching structure according to FIG. 5.
Figure 7:
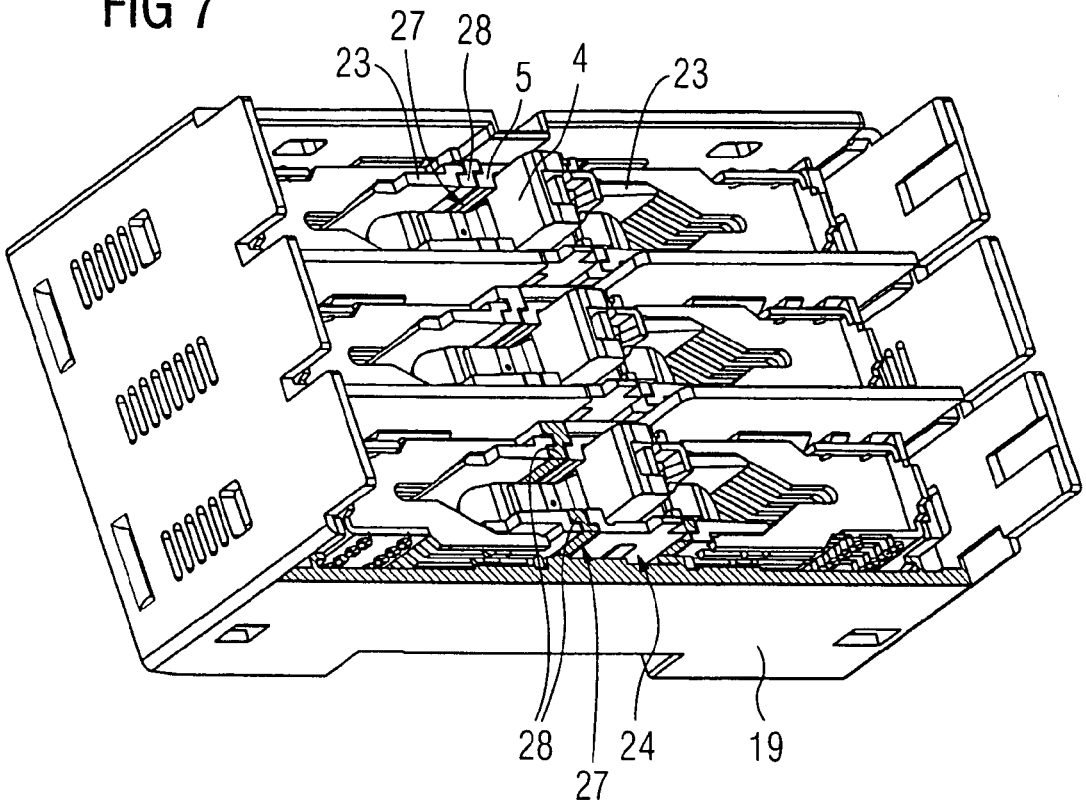
FIG. 7 is a view of a bottom part with inserted switching structures.

A switching device according to the invention has a switching structure 1 that includes a cage assembly 21 and two arc splitter assemblies 22, which are spaced apart from the cage assembly 21 by a gap 27 as illustrated in FIG. 6. The cage assembly 21 has a cage 24 formed by two opposite first sidewalls 5 and a bottom wall 6 integrally connecting the same as shown in FIGS. 5 and 6 and a slide 4 displaceably arranged therein. A moving contact bridge 3 associated with stationary contact members is held in an opening 15 of the slide 4 under the pressure of a contact pressure spring 2. The cage 24 has a passage 14 leading from its interior 7 toward the outside, which enables the insertion of the contact bridge 3 into the interior of the cage 24 substantially perpendicular to the longitudinal extent of the contact bridge for mounting between the contact pressure spring 2 and the slide 4. A clearance 26 is provided between the two first sidewalls 5 for the displacement of the contact bridge 3. A limit stop 18 is provided to retain the slide 4. The switching structure 1, as shown in FIG. 7, further includes arcing chambers formed by insulating second sidewalls 23, in which an opening arc is created when a high current is interrupted. The arc splitter plates 16 have a region with elongated feet, which enclose the second sidewalls 23 and cause the arc to drift away from the contact points. The second sidewalls 23 together with the arc splitter plates 16 form the arc splitter assembly 22. On the opposite side of the cage assembly 21 and spaced apart therefrom by a gap 27, an arc splitter assembly 22 is arranged, which partly encloses the contact bridge 3, as illustrated in FIG. 6. According to one production method of the invention, the first sidewalls 5 and the second sidewalls 23 can be parts of an originally integral molded part made of an insulating material, as illustrated in FIG. 5.

The first sidewalls 5 have the limit stop 18 for the slide 4. The slide 4 can be latched to the first sidewalls 5 and is provided with latching elements 12, which engage in slots 11 formed longitudinally to the direction of movement of the slide 4.

The two first sidewalls 5 are connected at two opposite long sides by a bottom wall 6, against which the contact pressure spring 2 is supported.

FIG. 7 shows a bottom part 19, typically made of an insulating material, which has a first web 28 that engages in a form-locking manner with the gap 27 between the cage assembly 21 and the second sidewalls 23.

Figure 8:
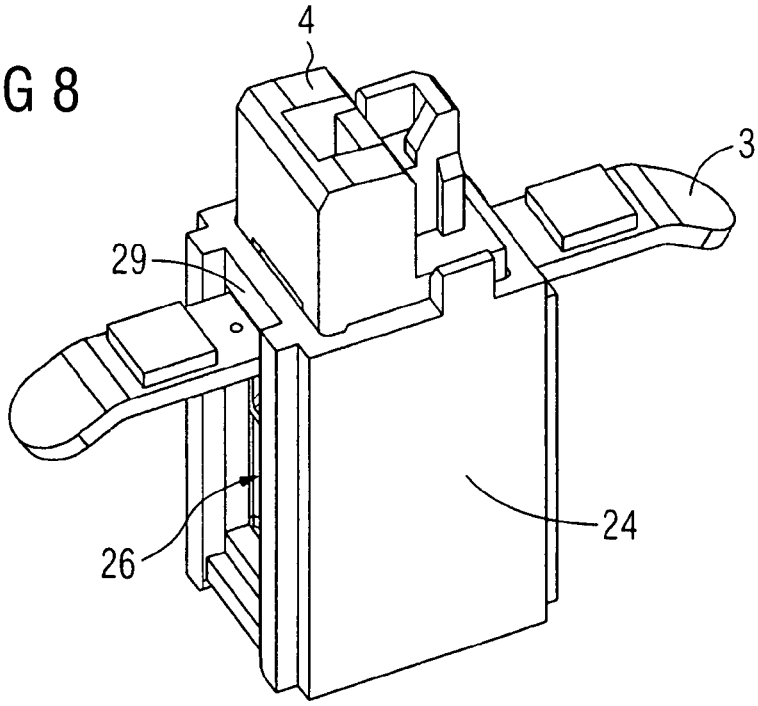
FIG. 8 is a view of an alternative cage assembly.

According to a second embodiment, the two first sidewalls 5 are interconnected by at least one second web 29 on the side facing away from the bottom wall 6. This delimits at least one of the clearance spaces 26 for displacing the contact bridge 3 as shown in FIG. 8. In this case, the second web 29 can stiffen the cage assembly 21 and/or act as a limit stop for the contact bridge 3.

Figure 9:
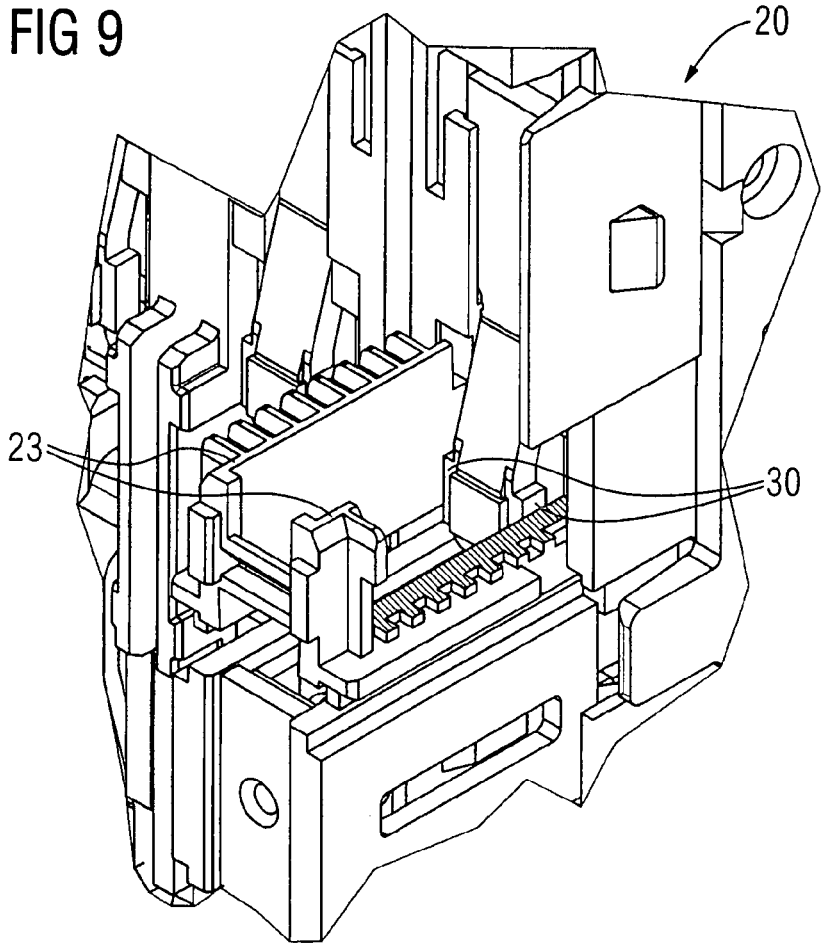
FIG. 9 is a perspective cutaway view of a bottom part with the top part.

According to a further embodiment, the two second sidewalls 23 can be integrally interconnected in a U-shape, as illustrated in FIG. 9.

In the embodiment according to FIG. 9, the two second sidewalls 23, along the side facing away from their connection, are fixed by a spacer 30, which belong to the top part 20 or to components received in the top part 20. Here, the spacer 30 is configured as projections on the stationary contact members disposed in the top part 20. Of course, other ways of fixing the sidewalls 23 by spacing as known in the art are envisioned.

Figure 10:
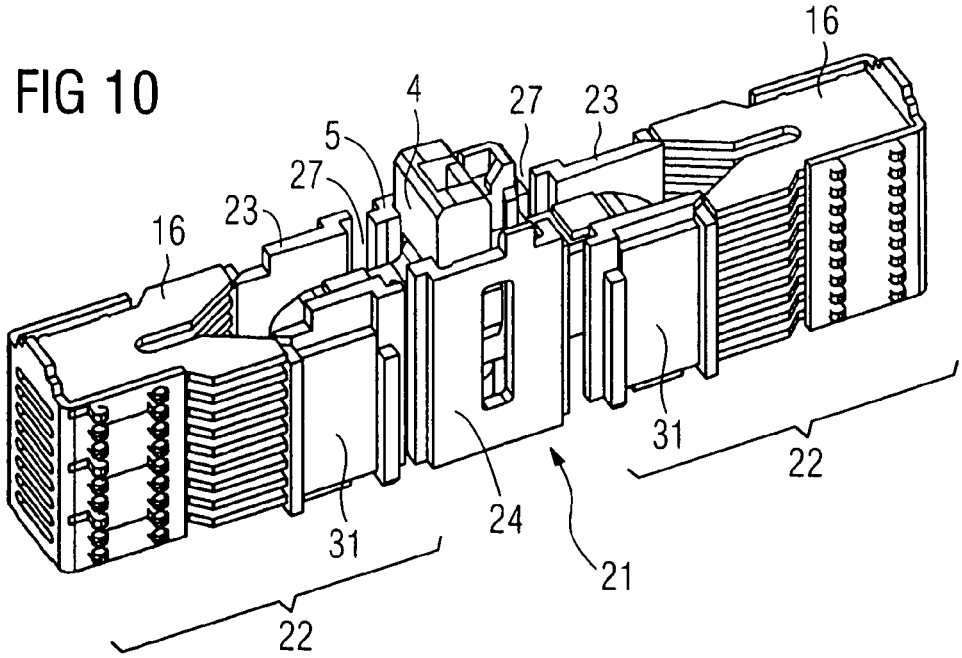
FIG. 10 is a perspective view of a switching structure of a switching device according to the invention before it is installed in a bottom part.

To influence the opening arc, at least one blow plate 31 is provided as shown in FIG. 10, which in the present example is pressed against the outside of the second sidewalls 23. The blow plate 31 represents an alternative solution to the feet of the arc splitter plates 16 shown in FIG. 6. It likewise causes the arc to drift away from the contact point. FIG. 10 shows a switching structure of a switching device according to the invention prior to installation in a bottom part, i.e., the sidewalls 23 with the arc splitter plates 16 and the cage assembly 21 are separate components.

The invention further relates to a method for producing a switching device according to the invention with the above-described switching structure 1. This method will now be described in greater detail.

First, the molded part is produced, which includes the cage 24 formed by the two opposite first sidewalls 5 and the bottom wall 6 integrally connecting the same and the second sidewalls 23 integrally connected to the cage 24. The first sidewalls 5, the second sidewalls 23 and the bottom wall 6 form an interior space which in a plane largely parallel to the bottom wall 6 has a passage 14 to the outside having a length corresponding to at least the length of the contact bridge 3.

Subsequently the contact pressure spring 2, the contact bridge 3 and the slide 4 are inserted into the cage 24 through the passage 14, and the arc splitter plates 16 are fixed to the second sidewalls 23 to obtain the switching structure 1 shown in FIG. 6. The arc splitter plates 16 can be fastened by inserting them in grooves 13 of the second sidewalls 23 as illustrated in FIGS. 5 and 6 to obtain a finally assembled switching structure 1.

Thereafter, the molded part of the switching structure 1 is separated at the point where the second sidewalls 23 are connected to the cage 24, e.g., in a milling or cutting process, such that the cage assembly 21 and the two arc splitter assemblies 22 shown in FIG. 6 are obtained.

Subsequently, the cage assembly 21 and the separated second sidewalls 23 are inserted into the bottom part 19, with or without the arc splitter plates 16, as illustrated in FIG. 7, such that a defined gap 27 each remains between the cage assembly 21 and the second sidewalls 23.

Instead of the cage 24 being open toward the top and being provided with the passage, it may alternatively have second webs 29 as described in DE 69302599 T2.

The sidewalls 23, referred to as insulating wings in that document, are severed once the cage 24 has been equipped with the contact pressure spring 2, the contact bridge 3 and the slide 4. The resulting cage assembly 21 and the severed sidewalls 23 are in turn inserted into the bottom part 19 of the switching device, either with or without arc splitter plates, such that they are spaced apart from one another by a defined gap 27. The edge contours of the gaps 27 are preferably predetermined by the production process.

The above description of the exemplary embodiments has been given by way of example. From the disclosure given, those skilled in the art will not only understand the present invention and its attendant advantages, but will also find apparent various changes and modifications to the structures and methods disclosed. It is sought, therefore, to cover all such changes and modifications as fall within the spirit and scope of the invention, as defined by the appended claims, and equivalents thereof.

What is claimed is:

1. A switching device with a switching structure, comprising:

a cage assembly having opposing first sidewalls and a bottom wall integrally connecting the first sidewalls;

a slide displaceably arranged in said cage assembly;

a limit stop to retain the slide;

a moving contact bridge associated with stationary contact members held in an opening of the slide under pressure of a contact pressure spring, wherein said moving contact bridge extends in a longitudinal direction; and two pairs of insulating second sidewalls forming arcing chambers, wherein the second sidewalls of each pair delimit a volume which contains opening arcs, each of said second sidewalls of each pair having an inner side facing the respective volume which contains opening arcs, and an outer side opposite to said inner side, wherein each pair of the second sidewalls is enclosed by arc splitter plates such that one of said arc splitter plates abuts the outer side of two of said second sidewalls of one of the pairs, and wherein a clearance space is provided between the first sidewalls for displacement of the contact bridge, and the second sidewalls are arranged on opposing sides of the cage assembly and are respectively separated therefrom in the longitudinal direction by a gap.

2. The switching device as claimed in claim 1, wherein the first sidewalls are two in number, and wherein the cage assembly is configured at least as a partial cage.

3. A switching device with a switching structure, comprising:

a cage assembly having opposing first sidewalls and a bottom wall integrally connecting the first sidewalls;

a slide displaceably arranged in said cage assembly;

a limit stop to retain the slide;

a moving contact bridge associated with stationary contact members held in an opening of the slide under pressure of a contact pressure spring; and insulating second sidewalls forming arcing chambers, wherein a clearance space is provided between the first sidewalls for displacement of the contact bridge, and wherein the second sidewalls delimit a volume which contains opening arcs, and the second sidewalls are arranged on opposing sides of the cage assembly and are respectively separated therefrom by a gap, wherein a first web of an insulating material engages with the gap.

4. The switching device as claimed in claim 3, wherein the first web is part of a bottom part in which the cage assembly is arranged.

5. The switching device as claimed in claim 1, wherein the first sidewalls are connected by at least one second web on a side facing away from the bottom wall, whereby one or more of the clearance spaces for the contact bridge is delimited.

6. The switching device as claimed in claim 5, wherein the second web acts as a limit stop for the contact bridge.

7. The switching device as claimed in claim 1, wherein the second sidewalls are integrally interconnected in a U shape.

8. The switching device as claimed in claim 7, wherein the second sidewalls are fixed by a spacer on a side facing away from their connection, wherein the spacer is not part of the second sidewalls.

9. The switching device as claimed in claim 1, wherein the first sidewalls and the second sidewalls are parts of an integrally molded part comprised of an insulating material.

10. The switching device as claimed in claim 1, wherein at least one blow plate is provided for each switching point to influence the opening arcs.

11. The switching device as claimed in claim 1, wherein the first sidewalls include the limit stop for the slide.

12. The switching device as claimed in claim 1, wherein the slide is latched to the first sidewalls.

13. The switching device as claimed in claim 1, wherein the slide has latching elements, which engage with slots that are formed longitudinally to a movement direction of the slide.

14. The switching device as claimed in claim 1, wherein the first sidewalls are connected on two opposing long sides by the bottom wall against which the contact pressure spring is supported.

15. The switching device as claimed in claim 1, wherein said first and second sidewalls are not overlapped in a direction perpendicular to the longitudinal direction.

16. The switching device as claimed in claim 1, wherein said first and second sidewalls are positioned so that longitudinal ends of respective first and second sidewalls are opposite one another across the gap.

17. The switching device as claimed in claim 1, further comprising a bottom part having walls defining a space in which said switching structure is disposed.

* * * * *